US010040529B1

(12) United States Patent
Salani

(10) Patent No.: US 10,040,529 B1
(45) Date of Patent: Aug. 7, 2018

(54) SIMPLIFIED SAILING RIG

(71) Applicant: Steven J. Salani, El Segundo, CA (US)

(72) Inventor: Steven J. Salani, El Segundo, CA (US)

(73) Assignee: Steven J. Salani, Inglewood, CA (US)

( * ) Notice: Subject to any disclaimer, the term of this patent is extended or adjusted under 35 U.S.C. 154(b) by 0 days.

(21) Appl. No.: 15/658,903

(22) Filed: Jul. 25, 2017

(51) Int. Cl.
*B63H 9/04* (2006.01)
*B63H 9/10* (2006.01)
*B63H 9/08* (2006.01)

(52) U.S. Cl.
CPC ..... *B63H 9/10* (2013.01); *B63H 2009/088* (2013.01)

(58) Field of Classification Search
CPC ..... B63H 9/10; B63H 9/06
USPC ..... 114/102.16
See application file for complete search history.

(56) References Cited

U.S. PATENT DOCUMENTS 3,438,349 A * 4/1969 O'Gorman ..... B63H 9/10 114/204
3,626,883 A * 12/1971 Ellis ..... B63H 9/10 114/102.19
4,819,574 A * 4/1989 Westerman ..... B63H 9/10 114/102.17
4,969,411 A * 11/1990 Smernoff ..... B63H 9/10 114/102.19
5,188,052 A * 2/1993 Breuer ..... B63H 9/10 114/204
5,485,799 A * 1/1996 Julien ..... B63H 9/06 114/102.16
5,524,565 A * 6/1996 Lavin ..... B63H 9/04 114/219
5,603,276 A * 2/1997 Julien ..... B63H 9/06 114/39.21
5,988,086 A * 11/1999 Mitchell ..... B63H 9/08 114/102.15

* cited by examiner

*Primary Examiner* — Stephen P Avila

(57) ABSTRACT

A simplified sailing rig is disclosed that is easier to operate and maintain than the conventional Bermuda rig. The entire rig can be rotated under manual or electric control to achieve the optimum angle of attack into the wind.

6 Claims, 3 Drawing Sheets

SIMPLIFIED SAILING RIG

BACKGROUND OF THE INVENTION

Traditional sailboats have very complicated sailing rigs. The standard Bermuda rig is difficult to operate and maintain. The sailor must manage an intimidating profusion of control lines including halyards, main sheet, jib sheets, outhaul, travelers, stays, reefing lines, tensioning lines, and more. The sheer number of mechanical components also makes the system prone to failure.

The present invention addresses this problem while providing additional benefits.

SUMMARY OF THE INVENTION

The present invention discloses a new simplified sail configuration that is substantially easier to operate and maintain in comparison to the typical Bermuda rig found on most sailboats.

The rig includes a forward sail and an aft sail which can be rotated simultaneously to the optimum angle of attack for the current wind direction. The rotation of the rig can controlled manually or by electric means.

DETAILED DESCRIPTION OF THE INVENTION

Figure 1:
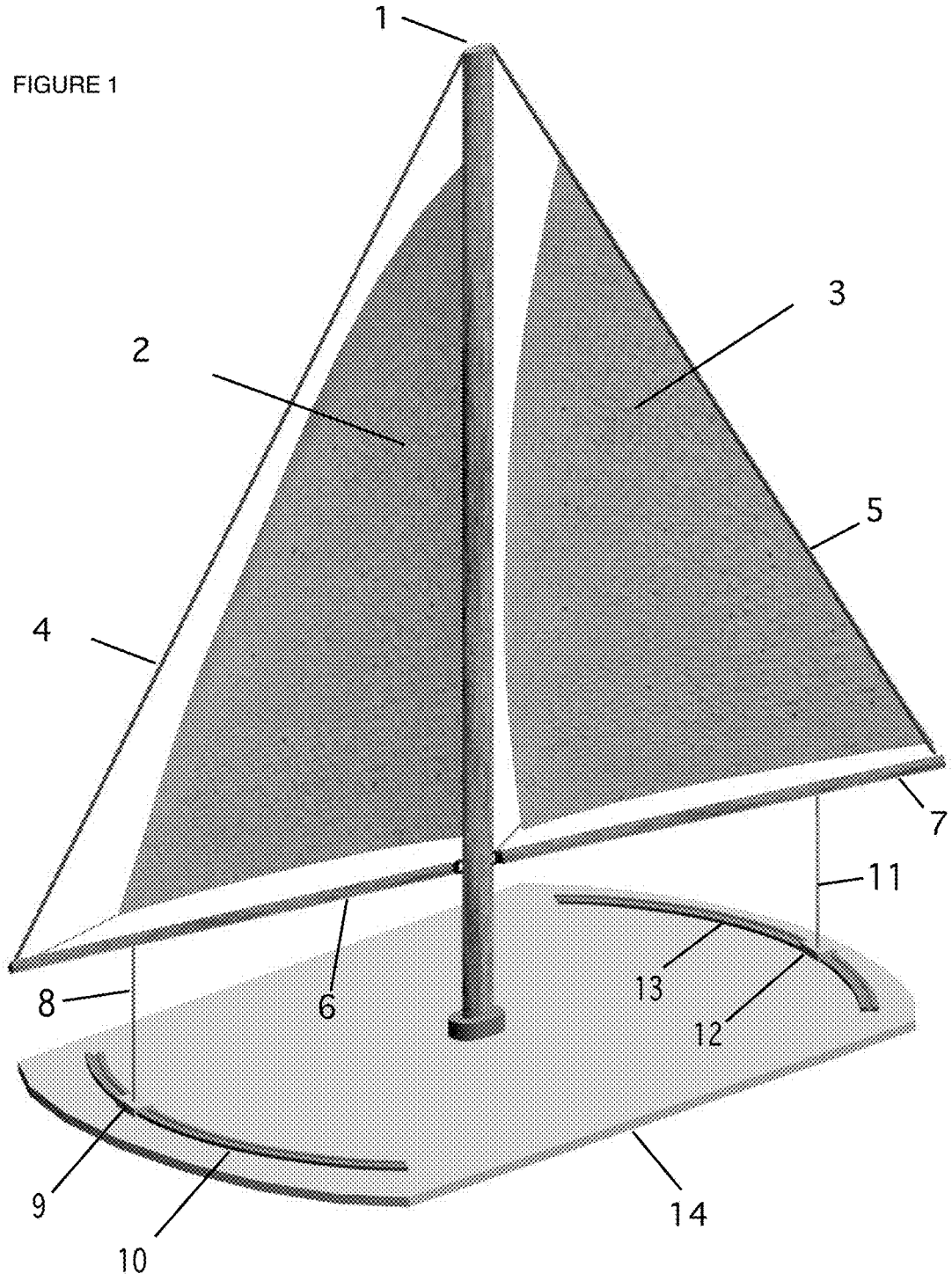
FIG. 1 is a perspective view of the basic embodiment of the sailing rig.

FIG. 1 shows the components of the basic embodiment of the sailing rig. The rig includes a mast 1 mounted on a boat deck 14, a forestay 5, and a backstay 4. A head sail 3 is suspended in the area between the forward stay 5 and the mast 1. A main sail 2 is suspended between the mast 1 and backstay 4.

The manner in which the sails are attached to said mast and stays is not relevant to the present invention, and may include any of the conventional elements such as bolt rope and tracks, hanks, or roller furling devices typically used on sailboats. An aft boom 6 is positioned between the backstay 4 and the mast 1. A forward boom 7 is positioned between the forestay and the mast. A curved aft track 10 is mounted to the boat deck under the aft boom, and a forward curved track 13 is mounted to the deck under the forward boom. The forward and aft curved tracks may alternately be mounted on vertical hull surfaces at the front and back of the boat, provided the hull has a suitable geometry. An aft sliding car 9 can travel to any position along the aft curved track, and a forward sliding car 12 can travel to any position along the forward curved track. The radius of curvature of the forward and aft curved tracks is such that the sliding car will always be the same distance from the mast, regardless of the car's position. An aft tension line 8 connects the aft sliding car to the aft boom, and a forward tension line ii connects the forward sliding car to the forward boom. Sliding car and track systems are well-known and commercially available in the marine industry, so the specific mechanical details are not relevant to the present invention. The only requirement is that the cars are strong enough to accept the upward force applied by the tensioning lines while still remaining attached to the track.

Figure 2:
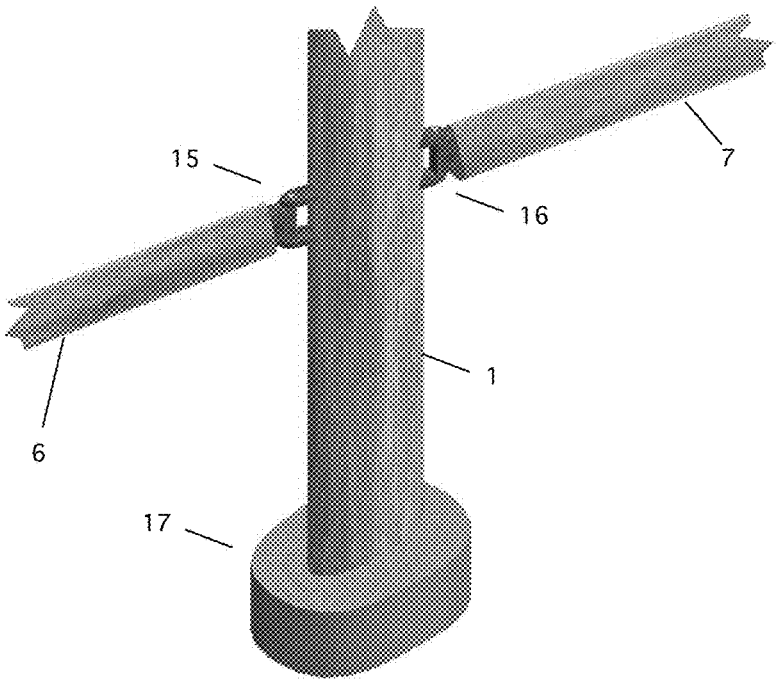
FIG. 2 is a detail view of the boom and mast connections.

FIG. 2 is a detailed view of the boom and mast connections. In the first embodiment, the aft boom 6 is attached to the mast 1 with a gooseneck 15 which allows the mast to swing in a horizontal plane towards the left or right side of the boat. Similarly, the forward boom 7 is attached to the mast 1 with another gooseneck 16 that allows the forward mast to swing to the left or right. Marine goosenecks (hinges) are commercially available in the marine industry, so the mechanical design of this component is not relevant to the present invention. The mast 1 is rigidly attached to the deck of the boat with a step (fitting) 17 as commonly used on sailboats. The mast may be supported by spreaders and shrouds if necessary, but these components are not relevant to the present invention and are not depicted in the drawings.

Figure 3:
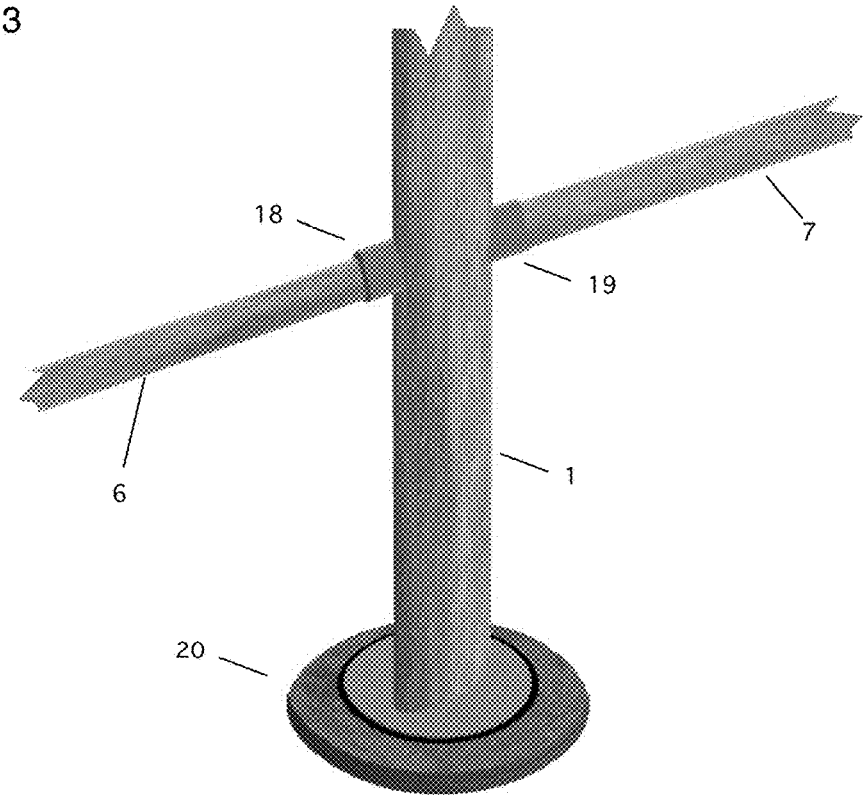
FIG. 3 is a detail view of an alternate embodiment of the boom and mast connections.

Is is clear from the figures and description that the sailing rig is able to rotate in either direction about the mast in order to put the sails at the optimum angle of attack to the wind. FIG. 3 shows an alternate embodiment in which the booms are rigidly attached to the mast by fittings 18 and 19. The bottom of the mast is fitted into a rotatable step 20. The rotatable step is a commercially-available assembly that uses a ball joint, ball bearings, or roller bearings that allow the mast to rotate freely about its axis. This embodiment provides the benefit of smoother and more efficient airflow around the mast, as its angle of attack to the wind changes as the rig is rotated.

Figure 4:
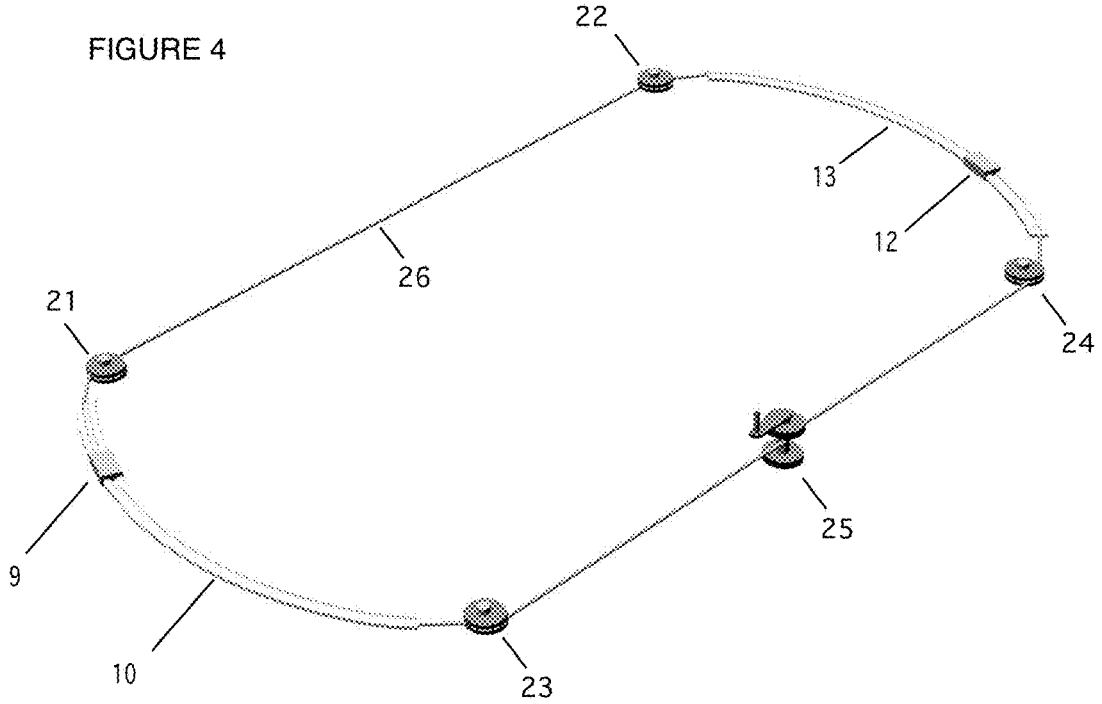
FIG. 4 shows a car positioning means using a continuous control line and a winch.

In order to rotate the sailing rig to the desired position, a car positioning means is required. FIG. 4 depicts a car positioning means incorporating a control line 26 whose ends are spliced together to form a continuous loop. The control line is guided by the aft curved track 10 and forward curved track 13, as well as multiple pulleys 21, 22, 23, and 24. Depending on the boat's hull and deck layout, additional pulleys may be used to guide the control line along a convenient path, but the basic operation is the same regardless of the number of pulleys. The control line attaches to the sliding cars so that they move along the track as the control line moves. The control line 26 also loops around a winch 25 that is used to move the control line in either direction. The winch may be operated manually, or it may be an electric winch that can run in both forward and reverse directions. The ability to control the sailing rig's orientation electrically has the advantage that an electronic autopilot system may be incorporated to provide automatic adjustments as the wind direction changes.

Figure 5:
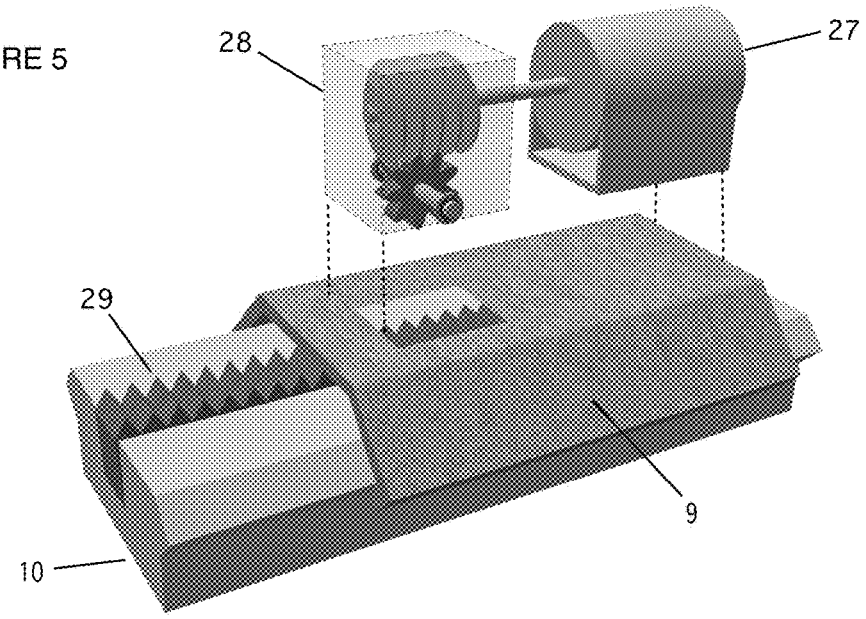
FIG. 5 shows a car positioning means using an electric motor and gear reduction assembly.

FIG. 5 shows an alternate car positioning means. An electric motor assembly 27 is fixed to the sliding car 9. The electric motor assembly is coupled to a reduction gear assembly 28 which engages a gear rack 29 within the curved track 10. The reduction gear assembly is depicted with two gears, however many equivalent gear reduction configurations may be employed to set the rate at which the sliding car moves. The scope of the present invention is therefore not limited by the example in the specification, but is defined by the claims. This alternate car positioning means eliminates the control line and pulleys of the previous car positioning means, thereby simplifying the installation of the sailing rig.

CONCLUSION

The patent discloses a new simplified sailing rig that is easier to operate and maintain than the conventional Bermuda rig. The simplified sailing rig is suitable for use with an electronic sail control system that provides automatic adjustment of the sails' angle of attack to the wind.

The invention claimed is:

1. A simplified sailing rig that includes:

(a) a mast that's rigidly connected to the boat via a step mast fitting, (b) an aft boom connected to the mast by a gooseneck hinge that allows the boom to swing to the left or right side of the boat (c) a forward boom connected to the mast by a gooseneck hinge that allows the boom to swing to the left or right side of the boat (c) a forestay connected between the foreword boom and the top of the mast, (d) a backstay connected between the aft boom and the top of the mast, (e) a forward sail suspended between the forestay and the mast, (f) an aft sail suspended between the backstay and the mast, (g) a curved forward track affixed to the forward region of the watercraft with a radius of curvature equal to the distance to the mast, (h) a forward sliding car that can move to any position on said forward track, (i) A forward tensioning line that connects said forward sliding car to said forward boom, (j) a curved aft track rigidly mounted to the aft region of the watercraft with a radius of curvature equal to the distance to the mast, (k) an aft sliding car that can move to any position on said aft track, (l) an aft tensioning line that connect said aft sliding car to said aft boom, (m) a car positioning means that moves the sliding cars to any desired location on their respective tracks, thereby causing the sailing rig to rotate about the mast to achieve the optimum angle to the wind.

2. The sailing rig of claim 1 where said car positioning means incorporates a control line guided by said curved tracks and a plurality of pulleys, with said control line attached to each of the sliding cars, and a manual or electric winch that causes the control line to move in either direction.

3. The sailing rig of claim 1 where said car positioning means incorporates an electric motor assembly, a reduction gear assembly, and a gear rack.

4. A simplified sailing rig that includes:

(a) a mast that's connected to the boat via a rotating step fitting that allows the mast to rotate around its longitudinal axis (b) an aft boom rigidly connected to the mast (c) a forward boom rigidly connected to the mast (c) a forestay connected between the foreword boom and the top of the mast, (d) a backstay connected between the aft boom and the top of the mast, (e) a forward sail suspended between the forestay and the mast, (f) an aft sail suspended between the backstay and the mast, (g) a curved forward track affixed to the forward region of the watercraft with a radius of curvature equal to the distance to the mast, (h) a forward sliding car that can move to any position on said forward track, (i) A forward tensioning line that connects said forward sliding car to said forward boom, (j) a curved aft track rigidly mounted to the aft region of the watercraft with a radius of curvature equal to the distance to the mast, (k) an aft sliding car that can move to any position on said aft track, (l) an aft tensioning line that connect said aft sliding car to said aft boom, (m) a car positioning means that moves the sliding cars to any desired location on their respective tracks, thereby causing the sailing rig to rotate about the mast to achieve the optimum angle to the wind.

5. The sailing rig of claim 4 where said car positioning means incorporates a control line guided by said curved tracks and a plurality of pulleys, with said control line attached to each of the sliding cars, and a manual or electric winch that causes the control line to move in either direction.

6. The sailing rig of claim 4 where said car positioning means incorporates an electric motor assembly, a reduction gear assembly, and a gear rack.

* * * * *